United States Patent [19]

Peace

[11] Patent Number: 4,602,250

[45] Date of Patent: Jul. 22, 1986

[54] TANK LEAKAGE DETECTION SYSTEM

[76] Inventor: Edward R. Peace, 41452 Thornton Ave., Hemet, Calif. 92343

[21] Appl. No.: 700,136

[22] Filed: Feb. 11, 1985

[51] Int. Cl.[4] ..... G08B 21/00

[52] U.S. Cl. ..... 340/605; 73/49.2; 206/524.3; 206/524.5; 340/624; 429/163; 429/176

[58] Field of Search ..... 340/605, 623, 624, 625; 73/49.2, 40, 313, 308; 429/163, 176; 220/408, 427, 85 R; 206/524.3, 524.5

[56] References Cited

U.S. PATENT DOCUMENTS

| | | | |
|---|---|---|---|
| 684,697 | 10/1901 | Lloyd | 340/605 X |
| 1,802,124 | 4/1931 | Phifer | 340/624 X |
| 1,838,135 | 12/1931 | Derby | 340/624 X |
| 4,524,609 | 6/1985 | Sharp | 73/49.2 |

*Primary Examiner*—James L. Rowland
*Assistant Examiner*—Daniel Myer
*Attorney, Agent, or Firm*—Boniard I. Brown

[57] ABSTRACT

This tank leakage detection system senses at an early stage the failure of a liner membrane made of a non-corroding material such as lead which allows the escape of a corrosive liquid contained within the tank to the space between the liner membrane and the outer steel walls of the tank. The detection system is made up of a small reservoir located on the bottom of the main tank which is in fluid communication with the space in the main tank between the outer steel walls and the liner membrane. The small reservoir extends laterally beyond one side of the tank and has a tubular projection extending upwardly along the side of the main tank which contains a float which is in turn connected via a linkage to a switch which controls an alarm system. The entry of corrosive fluid between the gap between the outer steel wall and the liner membrane of the main tank will drain into the small reservoir, causing the float in the tubular projection to rise in the tubular housing, thereby tripping the switch and activating the alarm system.

7 Claims, 4 Drawing Figures

FIG-1
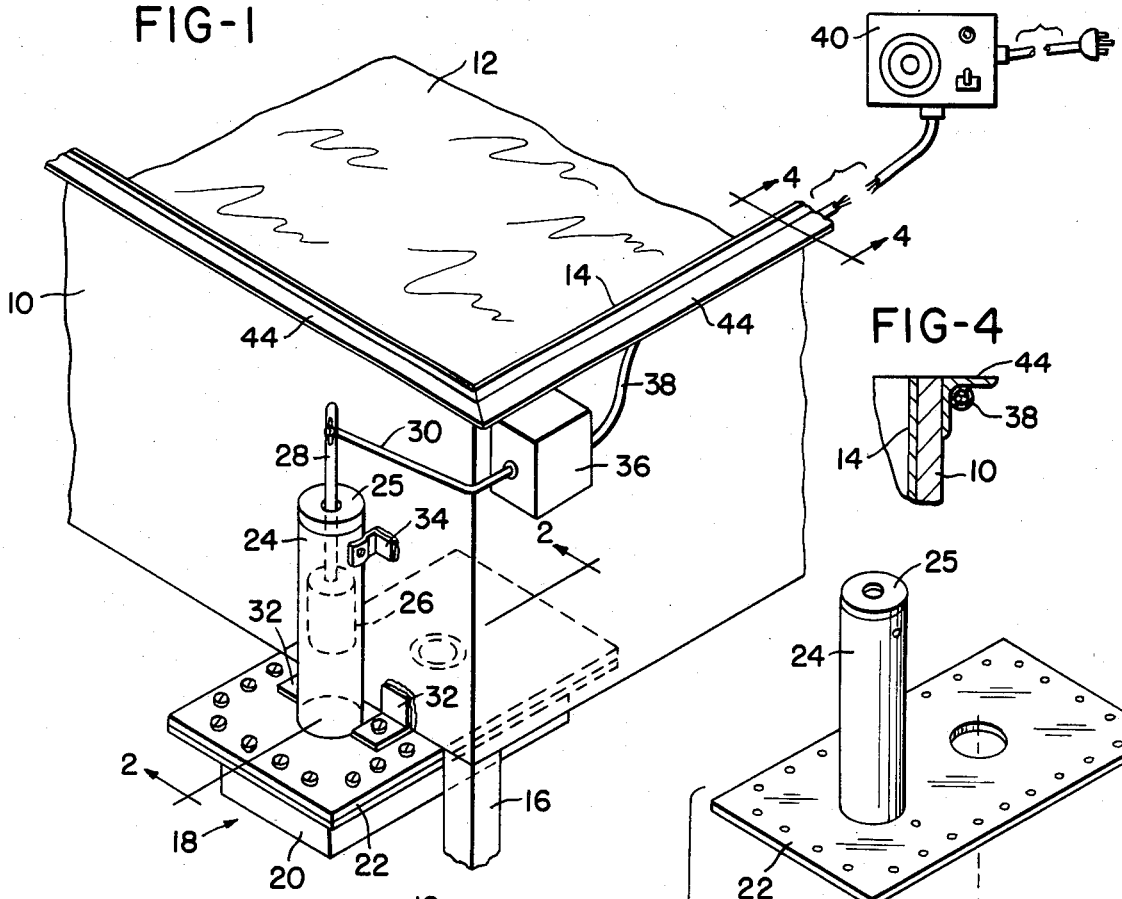
FIG-4
FIG-2
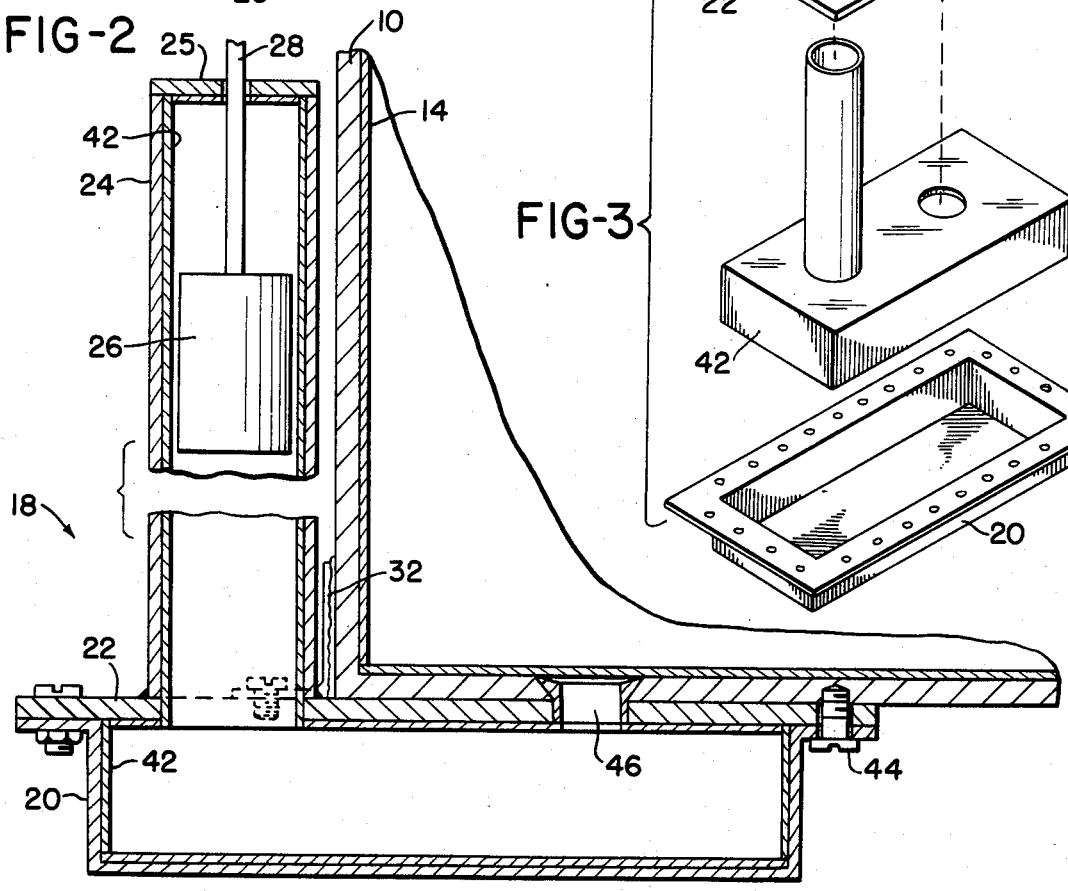
FIG-3
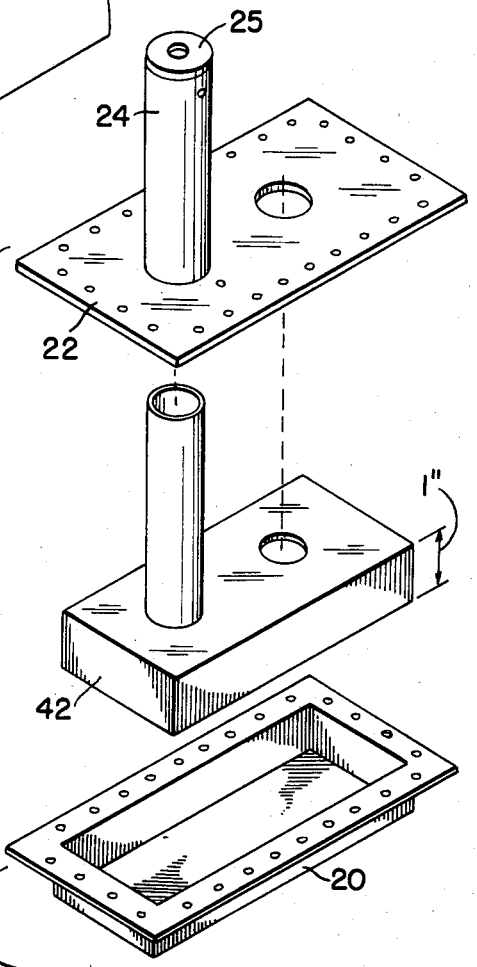

TANK LEAKAGE DETECTION SYSTEM

BACKGROUND OF THE INVENTION

This invention relates to alarm systems for liquid containing vessels. More particularly, this invention relates to alarm systems sensing the leakage of corrosive fluids into the space between a liner and the outer steel walls of a corrosive liquid containing tank.

Tanks for the confinement of corrosive solutions such as acid are typically fabricated of steel with a non corroding liner inside, normally made from lead. Such tanks find use in metal plating operations and other chemical cleaning applications. Upon the occurrence of a break or fracture in the lead lining of a tank, the corrosive liquid solution passes into the space between the lead lining and the outer steel walls of the tank. There it will collect and corrode away the outer wall of the steel tank. This seriously damages the structural integrity of the tank and will eventually cause other damage when the corrosive solution finally breaks through the outer walls and drains onto flooring or other objects in the vicinity of the tank. Also, serious environmental consequences can result if a hazardous corrosive substance such as a contaminated acid bath enters into a municipal sewage system without proper treatment.

If the leakage from the liner continues to any great extent, the entire tank assembly usually must be replaced. In some instances the steel tank can be repaired by a patch plate; however, all of the lead lining must be removed and replaced if such is to be done. Such repairs or replacement are quite expensive. It is therefore an object to provide for an early means of detecting failures in the liners to such corrosive liquid containing tanks before the damage to the steel outer tank reaches an irreversible stage.

SUMMARY OF THE INVENTION

The tank leakage detection system of this invention is designed for use in a corrosive liquid containing tank which has outer steel walls and an inner non-corroding liner. The detection system comprises a small reservoir which is located at least in part below the bottom of the tank and attached thereto, which is in fluid communication with the space between the outer steel wall of the tank and the inner non-corroding liner, and a float means within the reservoir mechanically connected to a switch which actuates an alarm means upon entry of the corrosive liquid into the reservoir which causes the upward movement of the float means and the resulting actuation of the switch and the alarm.

BRIEF DESCRIPTION OF THE DRAWINGS

FIG. 1 is a cut away partial isometric view of the overall layout of the leakage detection system;

FIG. 2 is a sectional view taken along section lines 2—2 shown in FIG. 1 showing a vertical section of the small reservoir and its tubular extension containing the float;

FIG. 3 is an exploded isometric view of the small reservoir with its upperly extending tubular extension showing the inner non-corroding liner and the upper and lower halves of the steel housing which contain the liner; and FIG. 4 is a partial sectional view taken along section lines 4—4 shown in FIG. 1 portraying a portion of an upper edge of the main tank showing the construction details of the tank, the upper flange, and the cable connecting the switch and the remote alarm means.

DETAILED DESCRIPTION OF THE INVENTION

Although applicable to a wide variety of implementations, it is envisioned that this invention will find its main usage with large tanks such as those used in metal plating operations. Typical sizes for such tanks are on the order of five feet by eight feet by six feet and these sizes can range from four feet by four feet by ten feet to ten feet by fifty feet, etc. Tanks of these sizes are expensive to purchase and expensive to repair. The alarm system of this invention normally actuates within a few minutes after the corrosive liquid, normally an acid, commences to pass through a break or a crack in the lead lining of the tank. Personnel are therefore quickly alerted and steps can be taken to rapidly drain the tank and neutralize the corrosive effects of the acid upon the steel tank. The prevention of damages provided by the system of this invention will be looked upon with great favor by insurance companies and governmental agencies such as OSHA and the EPA.

Before turning to the detailed description of the specific embodiment illustrated in the accompanying drawing figures, it should be realized that numerous variations and modifications to the specific embodiment may be practiced while still within the scope of the appended claims. For example, the specific construction illustrated herein applies mainly to acid bath solutions and comprises a steel outer tank with a lead inner liner. However, other types of corrosive liquids are perhaps better confined within different types of liners besides lead. Also, the term corrosive liquid should not restrict it solely to acidic solutions but may also include caustic solutions as well.

Turning now to FIG. 1, the tank holding the acid solution 12 is generally constructed of outer steel walls 10 with an inner lead liner 14. Normally the tank will be supported by a plurality of legs which raise it off the floor. Only one leg 16 is shown in the partial view in FIG. 1. The leakage detection system is shown attached to the bottom and the left side of the tank. The small reservoir 18 of the leak detection system is here shown with the lower housing half 20 and upper housing half 22 bolted together by the fasteners as shown. The small reservoir is attached to the tank by the angle brackets 32 and 34 as illustrated. The upper housing half 22 carries the tubular extension 24 in which is contained the float means 26. The float means is attached to a first link 28 which passes out through the top 25 of the tubular extension where it is connected by a cotter pin to a second link 30 which is in turn connected to a switch box 36 here shown as mounted against the right side of the tank wall. The switch 36 is electrically connected by the cable 38 to a remote alarm system 40 which may contain either an audio alarm such as a horn or a flashing light or both in addition to an ON-OFF switch. A power plug for the electrical components of the system is also shown. It should be noted that the components of the leak detection system are desirably shielded from splashing of the corrosive solution 12 by the presence of protecting flanges 44 attached to the top edge of the tank as shown. Also, it is desirable to mount this unit in such a position that splash from the normal utilization of the acid solution will not fall onto the components of the detection system.

FIG. 2 is a vertical sectional view taken along the section lines 2—2 shown in FIG. 1. This view shows again the outer steel walls 10 of the tank with the inner lead liner 14. Notice the holes 46 in the outer steel wall 10 and the upper housing half 22 of the small reservoir. These holes here register together providing fluid communication between the space between the outer steel wall 10 and the inner liner 14 of the tank and the interior of the small reservoir 18. Upon the formation of a break in the integrity of the liner 14 of the tank, the corrosive liquid will seep in between the liner 14 and the outer steel wall and find its way down into the bottom reaches of the tank and thereby into the interior of the small reservoir 18 of the leak detection system. This corrosive liquid will then act to fill up the small reservoir, causing the vertical upward motion of the float 26, which in turn will cause the first link 28 to rise upwardly and eventually trip the switch for the alarm. An additional fastener 44 holds the small reservoir against the bottom of the tank. Other construction details for the small reservoir shown in FIG. 2 include the lead liner 42, the lower housing half 20, and the upper housing half 22. The upper housing half 22 includes the upwardly extending tubular portion 24 which contains the float 26.

FIG. 3 is an exploded isometric view of the construction of the small reservoir. Shown again are the lower housing half 20, the inner lead liner 42, and the upper housing half 22. The lower housing half 20 is here formed of ten gage steel sheet, the inner liner 42 is here formed of ten pound lead sheet, and the upper housing half 22 is formed of three-eighths inch thick steel plate. The upper housing half here again includes the tubular extension 24 having the perforated top 25 which allows for the movement of the first link 28 illustrated in FIGS. 1 and 2.

FIG. 4 shows a construction detail of the top edge of the tank taken along section lines 4—4 as shown in FIG. 1. Here again is shown the outer steel wall 10, the inner lead liner 14, and the upper protective flange 44. The cable connecting the switch with the remote alarm is here labeled 38 and is attached in a secure fashion along the inner corner of the flange 44.

Again, it should be emphasized that the construction details presented above apply only to a specific embodiment of this invention. The materials used for this construction are not necessarily required for all usages contemplated by the scope of the claims appended below. For example, in many instances it may be appropriate to substitute fiberglass or plastic components for some or most of the steel and lead materials recited for the construction of the small reservoir. However, the practitioner should not lose sight of the fact that this invention is designed to be used in industrial environments in which severe usages and rough handling are the norm. Since this system would represent only an insignificant fraction of the cost of the tank which it is designed to protect, over building of the leak detection system would be appropriate.

I claim:

1. A leak detection system for a corrosive liquid containing tank having outer steel walls and a non-corroding liner comprising:

a small closed reservoir located at least in part below the bottom of the tank and attached thereto, said reservoir being in fluid communication with the space between the outer steel walls of the tank and the non-corroding liner of the tank, said reservoir further including an extension rising upwardly from the main body of the small reservoir and adjacent to a side of the tank, and float means within the reservoir extension and mechanically connected to a switch which actuates an alarm means upon entry of the corrosive liquid into the reservoir, the rising liquid causing upward movement of the float means, thereby tripping the switch, the float being free to travel within the extension upwardly from a first level at least slightly below the bottom of the tank liner, said first level representing a no alarm condition.

2. The system of claim 1 wherein the extension is cylindrical.

3. The system of claim 1 wherein the fluid communication between the space, located between the steel walls of the tank and the tank liner, and the reservoir is via an opening extending through an upper wall of said reservoir and the bottom wall of the outer steel walls of the tank.

4. The system of claim 3 wherein the opening is lined with a non-corroding liner material.

5. The system of claim 1 wherein the mechanical connection to the float comprises a first link which is attached at one end to the float, passes through an opening in the top end of the tubular extension, and is attached to a second link which is in turn attached to the switch.

6. The system of claim 5 wherein the switch is mounted on a side of the tank.

7. The system of claim 1 wherein the alarm means is located remote from the tank and is electrically connected to the switch.

* * * * *